US005275383A

United States Patent [19]

Wick et al.

[11] Patent Number: 5,275,383

[45] Date of Patent: Jan. 4, 1994

[54] METHOD AND WIRE TIE CONNECTION FOR SECURING FENCING FABRIC TO POSTS

[75] Inventors: Carl J. Wick, Gladstone; Jeff J. Lancour; Ronald D. Chouinard, both of Escanaba, all of Mich.

[73] Assignee: Wick, Ltd., Gladstone, Mich.

[21] Appl. No.: 65,464

[22] Filed: May 20, 1993

Related U.S. Application Data

[63] Continuation of Ser. No. 587,103, Sep. 24, 1990, abandoned.

[51] Int. Cl.[5] ..... B21F 7/00; E04H 17/00

[52] U.S. Cl. ..... 256/57; 256/47

[58] Field of Search ..... 256/57, 48, 47, 46, 256/33, 32, 35, 34, 56; 403/397, 214, 213, 216, 209, 212; 24/548, 546, 67.9

[56] References Cited

U.S. PATENT DOCUMENTS

| | | | |
|---|---|---|---|
| 385,318 | 6/1888 | Norris | 256/57 |
| 615,583 | 12/1898 | Snell | 256/57 |
| 769,320 | 9/1904 | Odell | 256/57 |
| 837,365 | 12/1906 | Wilson et al. | 256/57 |
| 1,153,380 | 9/1915 | Fussell | 256/57 X |
| 1,190,080 | 7/1916 | Bailey | 256/57 |
| 1,609,795 | 12/1926 | Carlson et al. | 250/57 |
| 1,667,463 | 4/1928 | Rose | 256/57 |
| 1,807,898 | 6/1931 | Davidson | 256/57 |
| 1,849,410 | 3/1932 | Selquist | 256/57 X |
| 2,053,195 | 9/1936 | Jernegan | 256/57 |
| 2,484,449 | 10/1949 | Fetterman | 256/57 |
| 2,907,553 | 10/1959 | Cookman | 256/57 |
| 3,169,750 | 2/1965 | Weed | 256/57 |
| 3,977,653 | 8/1976 | Fingerson et al. | 256/57 X |
| 4,270,581 | 6/1981 | Claxton et al. | 256/57 X |
| 4,838,726 | 6/1989 | Huerta | 256/57 |
| 4,899,990 | 2/1990 | Winders et al. | 256/57 |

*Primary Examiner*—Dave W. Arola
*Assistant Examiner*—Anthony Knight
*Attorney, Agent, or Firm*—John R. Benefiel

[57] ABSTRACT

A method and wire tie connection for joining wire fencing fabric and line posts, in which specially configured wire ties gripping the fencing fabric are twisted by rotating a twister implement to form a tight connection.

9 Claims, 5 Drawing Sheets

METHOD AND WIRE TIE CONNECTION FOR SECURING FENCING FABRIC TO POSTS

This is a continuation of copending application Ser. No. 07/587,103 filed on Sep. 24, 1990, now abandoned.

This invention concerns fencing and more particularly methods and apparatus for securing the chain link wire fabric fencing to line posts.

In some instances fencing is secured with special hardware items, which are expensive and time consuming to install. Wire ties have also been employed but heretofore a tight connection has been difficult to achieve, particularly where a large member of connections must be made. If the connection is loose, it will eventually work free. Also, loose connections for security fences create points of vulnerability in a fencing installation.

SUMMARY OF THE INVENTION

The present invention provides a method and wire tie connection for securing wire fencing fabric to line posts which very tightly secures the fencing fabric to the post and which may be made very quickly and reliably, and without the use of costly hardware or installation equipment.

A specially shaped wire tie is employed in making the connection, having a generally U-shaped tie having an end section connecting two slightly angled legs spaced apart sufficiently to straddle a line post and two strands of the fencing fabric. Well defined corners are formed at the intersection of the end section having a radius lying within a narrow range. The inside of the corners capture respective strands of the wire fencing fabric, and act to draw the fencing fabric and the wire tie legs tightly against the line post as the legs are twisted together.

The legs are twisted by a rotary tool driven by a portable drill, the tool including a disc having diametrically opposite pairs of holes machined therein, inclined circumferentially to create leading and trailing biting edges to avoid slipping of the wire tie legs and insure a powerful twisting action as the tool is rotated.

DETAILED DESCRIPTION

Figure 1A:
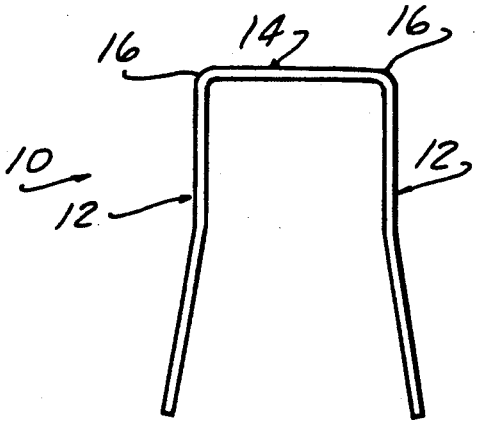
FIG. 1A is a plan view of a wire tie according to the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, and particularly FIG. 1 which shows a specially shaped wire tie 10 according to the present invention. The wire tie 10 is constructed of relatively heavy round metal wire, i.e., 6 gauge diameter aluminum, for example, and includes a pair of spaced apart legs 12 connected at one end by an intermediate section 14. The transition between the intermediate section 14 and each leg 12 comprises a discontinuity, i.e., well defined corners 16 are provided rather than a continuously blended shape. Well defined corners have been found to grip the strands of the fabric fencing and establish a powerful drawing action acting on the fence as the connection is made, pulling the fabric tightly to the post.

The corners 16 are shaped with an inside radius on the order of one half inch, i.e., within the approximate range from three eighths to five eighths of an inch. This radius allows each leg 12 to be lengthened slightly by shortening of the intermediate sections 14 as the legs 12 are twisted tight, as described below, while still gripping the fencing strands as described.

Figure 1B:
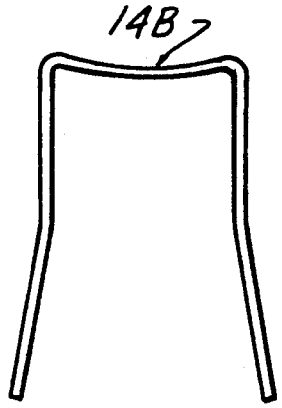
FIGS. 1B and 1C are plan views of alternate shapes of the wire tie according to the present invention.
Figure 1C:
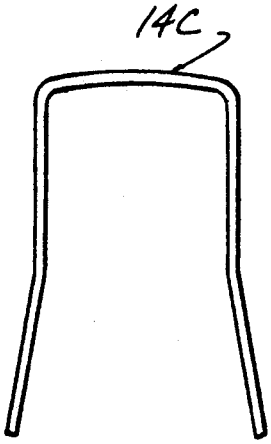

The intermediate section 14 should be straight for most posts, as shown in FIG. 1A, or slightly curved concavely or convexly as shown in FIGS. 1B and 1C respectively to fit smaller or oversized line posts respectively.

Figure 2:
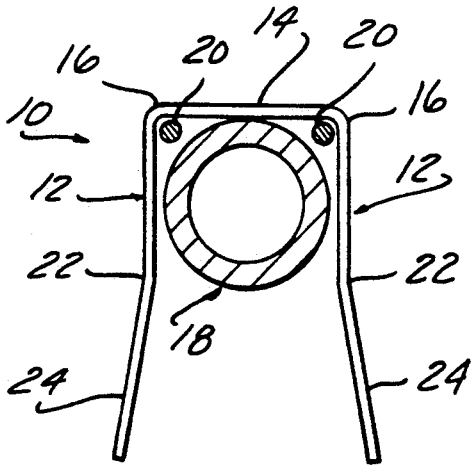
FIG. 2 is a plan view of an untwisted wire tie positioned straddling fencing wire strands and a fence post, shown in section.

The intermediate section 14 is sized to be slightly greater than the width of the line post 18 as shown in FIG. 2. The wire tie 10 is initially placed over a pair of strands 20 of the fence fabric so that the legs 12 straddle both the strands 20 and the line post 18.

Each of the legs 12 are formed with a slight bend 22 at a point projecting slightly beyond the post 18.

Figure 3:
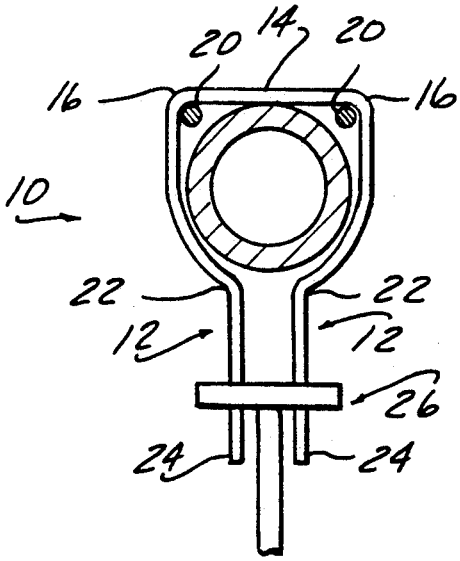
FIG. 3 shows a plan view of an untwisted wire tie according to the present invention positioned straddling wire fencing strands and a line post shown in section, the wire tie legs loaded into a twister tool preparatory to twisting of the wire tie.

This bend 22 serves the purpose of allowing easier insertion of the ends 24 of the legs 12 into a twisting implement 26, when the legs 12 are squeezed together as shown in FIG. 3.

Figure 4:
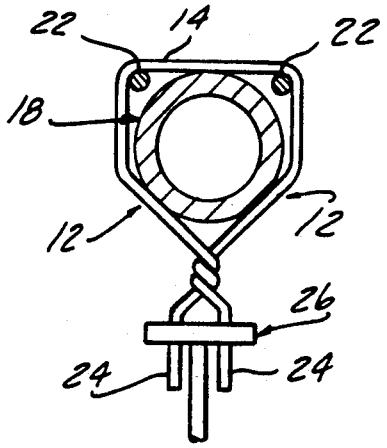
FIG. 4 is a plan view of a wire tie according to the present invention shown partially twisted around strands of fencing fabric and a post shown in section, by a twister tool, a portion of which also shown.
Figure 5:
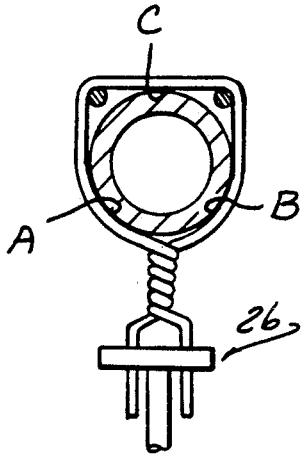
FIG. 5 is a plan view of a wire tie according to the invention fully twisted.

The bends 22 also control the point of twist as the twisting implement is rotated as shown in FIG. 4.

As the twisting of legs 12 is continued, the resistance of the corners 16 draws the intermediate section 14, and the strands 20 to the post 18, and creates tight contact at points A, B and C on the opposite side of the post 18. Thus, a very tight connection is achieved.

Figure 6:
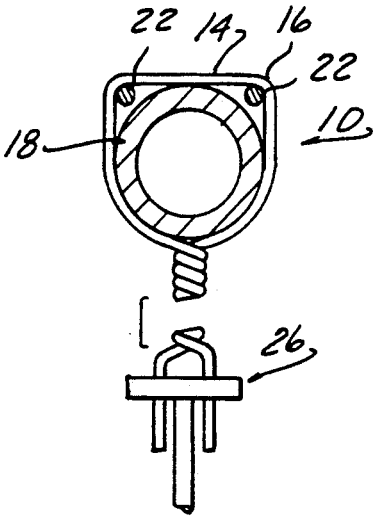
FIG. 6 is a plan view of a wire tie fully twisted and the end twisted off.

Thereafter, continuing twisting causes the legs to twist off, leaving several twists as seen in FIG. 6.

Figure 7:
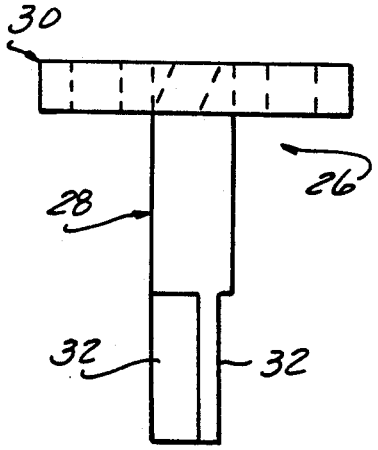
FIG. 7 is a side view of the twister implement used to make the fencing connections according to the present invention.
Figure 8:
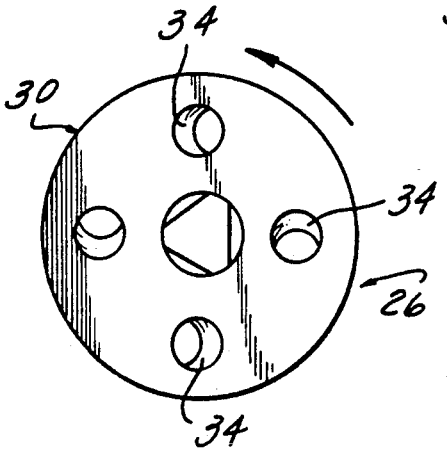
FIG. 8 is an end view of the twister implement shown in FIG. 7.

FIGS. 7 and 8 show the details of the twisting implement 26, designed to be driven by a portable drill.

The implement 26 includes a stem portion 28 having a disc portion 30 affixed at one end.

The other end of the stem portion 28 is preferably formed with several flats 32 to enhance the grip with the chuck of the portable drill.

The disc portion 30 is formed with two pairs of opposite through holes 34, spaced outward on a common radius. The holes 34 are inclined at an angle in the circumferential direction, towards the direction of rotation as indicated in FIG. 8.

This produces a biting or gripping edge on both the leading and the trailing sides of the holes 34, so that the legs 12 do not simply slip out of the holes 34 instead of being firmly twisted as desired. The twisting implement 26 should be made from a hard, wear resistant steel alloy so that the edge of the holes 34 does not get excessively and too quickly worn as the implement is used on the job.

Figure 9:
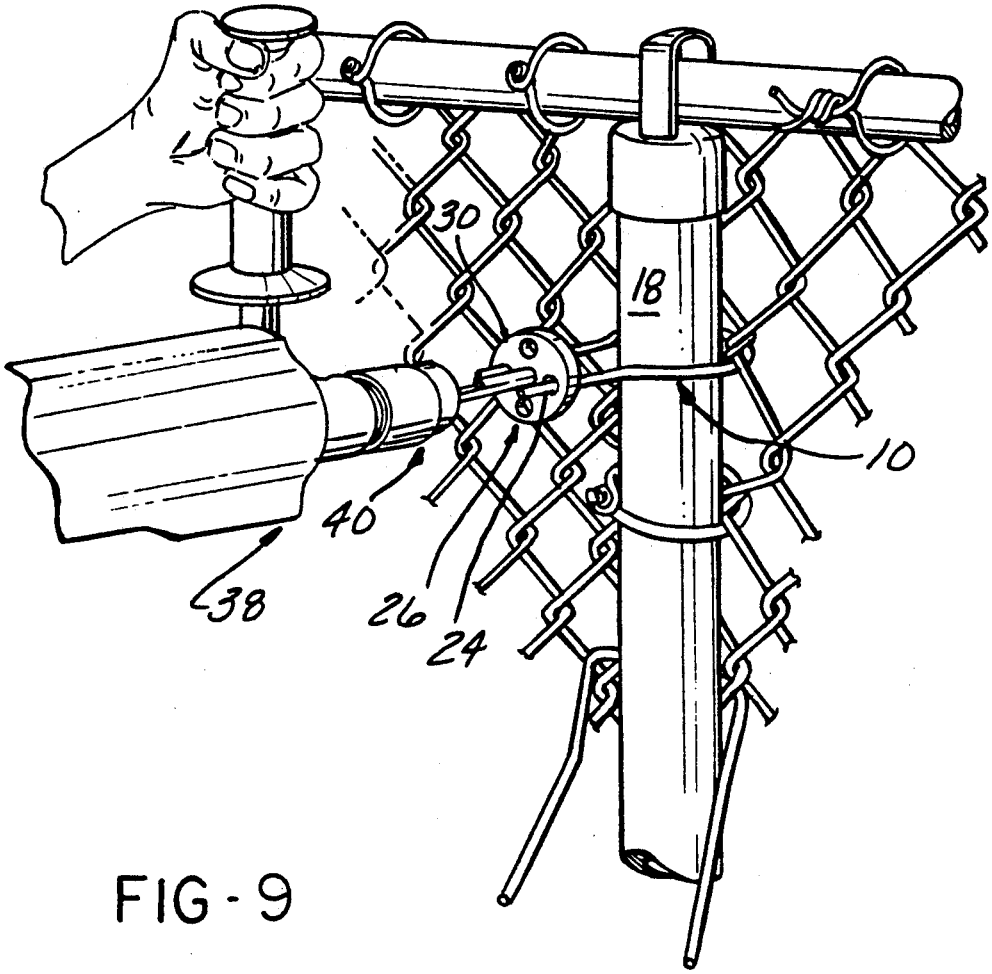
FIG. 9 is a fragmentary perspective view of a fabric fence section and line post with an untwisted wire tie according to the present invention shown installed preparatory to being twisted.
Figure 10:
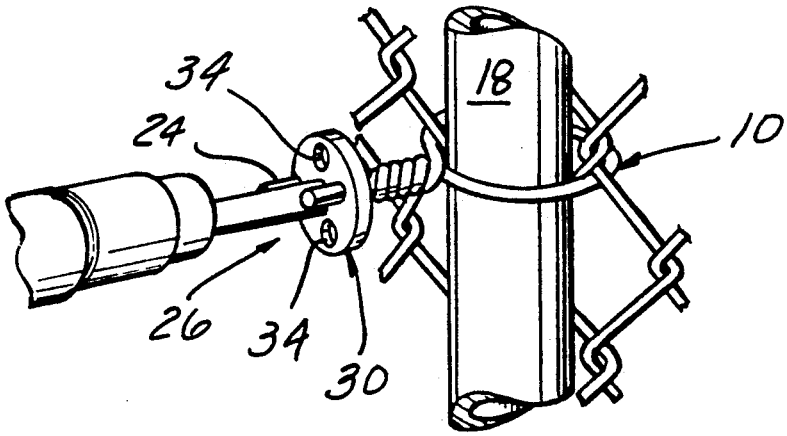
FIG. 10 is the fragmentary perspective view shown in FIG. 7, with the wire strand fully twisted.

FIGS. 9 and 10 show the making of a connection of a section of chain link wire fencing fabric 36 to a line post 18.

A portable drill 38 has the twister implement 26 installed in its chuck 40. The wire tie 10 is slipped over the line post 18 and a pair of strands 20 of the fencing fabric 36. The legs 12 are grasped and squeezed together so that the legs 12 may be inserted in a pair of the holes 34 in the twister implement 26.

The portable drill 38 preferably has a relatively gradual start, operating at 350 r.p.m. for best performance.

The rotation of the implement 26 thus causes twisting until a tight connection is made, and thereafter the end is twisted off to release the twisting implement 26. The twisted off ends may then be easily removed.

A tight connection between the fencing fabric and line post may thus be rapidly and efficiently made, facilitating installation of the fence. The wire tie is simple and may be fabricated at very low cost.

An alternate configuration of the wire tie may be employed where twisting off of the ends is not necessary, i.e., the projecting tails of the twisted ends may be left in place.

Figure 11A:
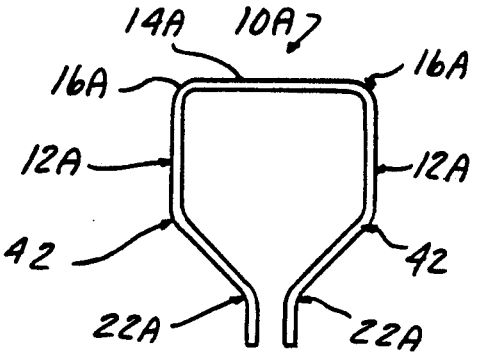
FIGS. 11A and 11B are plan views of other embodiments of the wire ties according to the present invention.
Figure 11B:
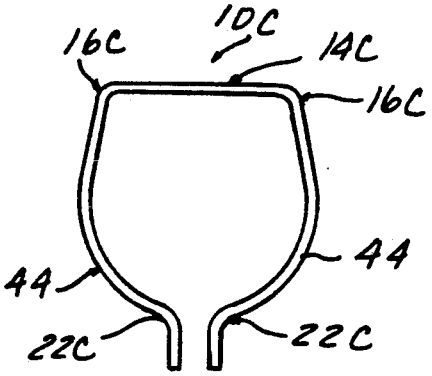
Figure 12A:
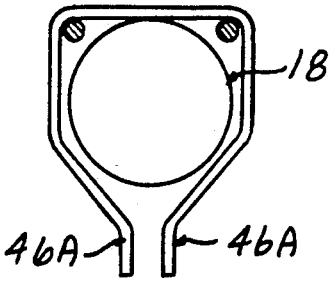
FIGS. 12A and 12B are plain views of the embodiment of FIGS. 11A and 11B assembled onto fence posts.
Figure 12B:
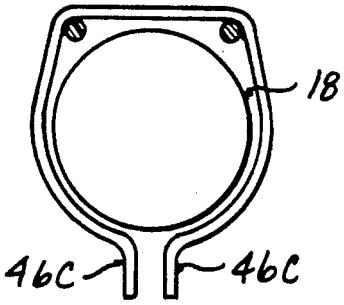
Figure 13:
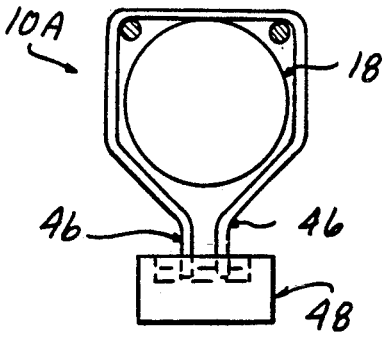
FIG. 13 is a plan view of the wire tie of FIG. 11A ,assembled onto a fence post and loaded into a twister tool.

The alternate configuration is shown in FIGS. 11A and 11B, 11A for small diameter posts, 11B for larger diameters. The wire tie 10A includes spaced apart legs 12A which have corner bends 16A connecting an intermediate section 14A. A pair of bends are included in each leg 12A, bend 22A as in the above embodiment but slightly further out, and also an additional bend 42 which causes the ends of the legs 12 to be positioned closely adjacent each other.

The wire tie 10C is similar but each leg 12C includes a gradually curving section 44 transitioning to bend 22C.

Thus, when assembled to a post 18, the ends 46A or 46C are positioned closely adjacent each other, and of much shorter length than in the above-described embodiment.

Figure 14:
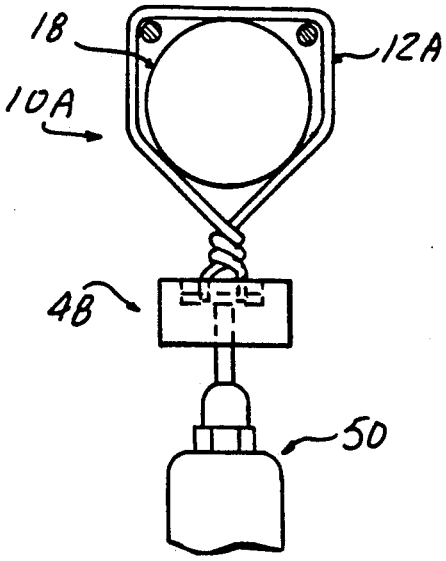
FIG. 14 is a plan view of the wire tie of FIG. 11A being twisted by a twister tool.

The ends 46A are inserted completely into respective blind holes in a twister tool 48, so as to set the depth of ends projecting into the tool 48. Rotation of the tool 48 by a torque limit controlled driver 50 causes twisting together of the ends 46 (FIG. 14). The proper torque limit can be determined empirically for each wire gauge, twist size, etc.

Figure 15:
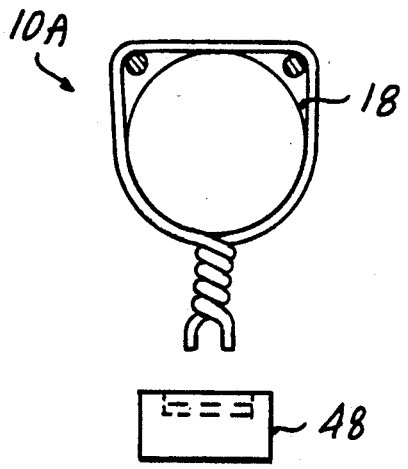
FIG. 15 is a plan view of the wire tie of FIG. 11A after twisting by a twister tool.
Figure 16:
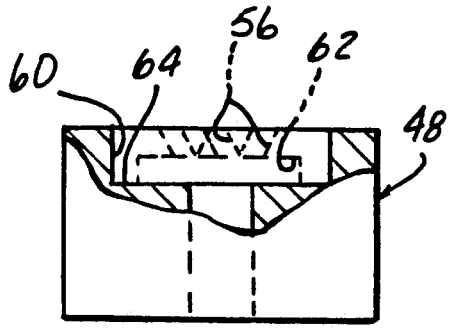
FIG. 16 is an enlarged end view of the twister tool.
Figure 17:
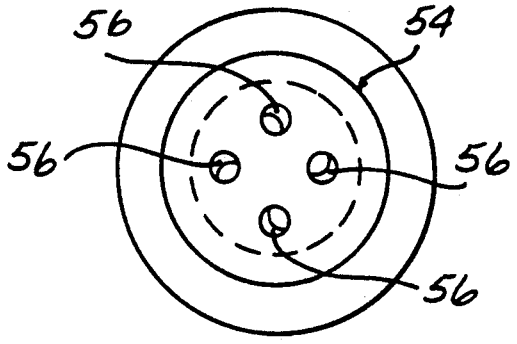
FIG. 17 is a plan view of the twister tool.
Figure 18:
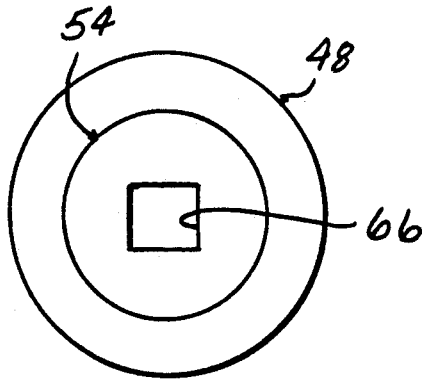
FIG. 18 is a rear end view of the twister tool.

In this embodiment, after the twist is completed, the torque limit prevents further twisting, and the tips 52 of the twisted ends project as shown in FIG. 15. The wire tie 10A (or 10C) is tightly drawn to the post 18 as in the above embodiment.

The twister tool 48 includes a die disc 54 having two diametrically opposite pairs of circumferentially inclined holes 56, more closely spaced than in the tool used with the first described wire tie embodiment. The inclined holes 56 create biting edges on the leading and trailing sides thereof as the tool 48 is rotated to firmly grip the inserted ends 46.

The die disc 54 is held in holder-driver 58 having a recess 60 receiving the die disc 54. The die disc has a counter bore 62 into which the holes 62 enter. The ends 46 are advanced against the bottom 64 of recess 60 such that the length to be inserted is conveniently gaged.

The tool holder driver 58 is rotated by means of a square drive hole 66 receiving a suitable driver bit.

This embodiment is usable where the presence of the ends 52 is acceptable.

We claim:

1. A method of connecting a wire fabric made up of a plurality of spaced apart woven wire strands to a generally round line post comprising the steps of:

forming a generally U-shaped wire tie with a pair of legs and a generally flattened connecting intermediate section, and curved corners located at the intersection of one end of each leg and either end of said intermediate section, said corners formed to have a much smaller radius of curvature than any curvature of said generally flattened intermediate section, said corners spaced apart at least a distance slightly greater than the width of said line post and approximately equal to the space between said woven wire strands, said legs formed to be of substantially greater length than the diameter of said line post;

holding a section of wire fabric against one side of said line post;

placing said wire tie around the line post and two of said spaced wire strands of said fabric, and holding said wire tie in place with said legs straddling said line post and with each of said two wire strands approximately positioned adjacent a respective corner of said wire tie, said intermediate section of said wire tie extending across said one side of said line post to position said two of said wire strands adjacent said one side of said line post and to position the other end of each leg of said wire tie so as to extend past the other side of said line post;

twisting said other end of each of said legs together to draw said two strands of said wire fabric towards said line post on said one side thereof and said legs against said line post on said other side thereof.

2. The method according to claim 1, wherein in said forming step, said wire tie is formed with said corners of an inside radius on the order of one half inch.

3. The method according to claim 1 wherein in said forming step, each of said legs is bent at a point just beyond the diameter of said line post to incline said other ends slightly outwardly.

4. The method according to claim 1 wherein said twisting step includes the step of placing a disc having diametrically opposite holes inclined in one circumferential direction over said legs so that said legs are received into said holes and subsequently rotating said disc about an axis intermediate said two holes in said one circumferential direction.

5. The method according to claim 4, further including the step of rotating said disc with a torque limited driver to twist together said other ends of said wire tie.

6. The method according to claim 4, further comprising the step of gaging the length of insertion of the wire tie legs by abutting said other ends of said legs against an end face contained within said diametrically opposite holes.

7. The method according to claim 1 wherein said other end of each of said legs are continued to be twisted together until said other ends are twisted off.

8. The connection formed by the method of claim 1.

9. A wire tie for a fencing connection comprised of a length of heavy wire formed into a generally U-shape, with a pair of spaced apart legs joined at one end by a generally flattened intermediate section to form a tie of a predetermined width defined by the distance across said spaced apart legs, corners formed at the junction of one end of each leg and said intermediate section; said corners having a radius of curvature much smaller than any curvature of said generally flattened intermediate section, said radius of said corners on the order of one half inch within a range of approximately $\frac{3}{8}$ to $\frac{5}{8}$ inches, said width of said wire tie on the order of several inches and the length of said legs several times the length of said intermediate section of said wire tie;

each of said legs having a parallel section at said one end thereof, said legs each bent at a slight angle at an intermediate point at an approximate distance from a respective corner equal to the length of said intermediate section to slightly incline the other end of each leg outwardly.

* * * * *